US008974022B2

(12) United States Patent
Mitsuki

(10) Patent No.: US 8,974,022 B2
(45) Date of Patent: Mar. 10, 2015

(54) INKJET PRINTER AND IMAGE RECORDING METHOD

(75) Inventor: Kiyoomi Mitsuki, Kyoto (JP)

(73) Assignees: Dainippon Screen Mfg. Co., Ltd., Kyoto (JP); Seiko Epson Corporation, Tokyo (JP)

( * ) Notice: Subject to any disclaimer, the term of this patent is extended or adjusted under 35 U.S.C. 154(b) by 101 days.

(21) Appl. No.: 13/621,082

(22) Filed: Sep. 15, 2012

(65) Prior Publication Data

US 2013/0083105 A1 Apr. 4, 2013

(30) Foreign Application Priority Data

Sep. 30, 2011 (JP) ..... P2011-216092

(51) Int. Cl.
*B41J 29/38* (2006.01)

(52) U.S. Cl.
USPC ..... 347/10; 347/14; 347/19

(58) Field of Classification Search
USPC ..... 347/9, 10, 11, 12, 5, 14, 19
See application file for complete search history.

(56) References Cited

U.S. PATENT DOCUMENTS 6,328,395 B1 12/2001 Kitahara et al.
7,708,363 B2 * 5/2010 Hoshiyama et al. ..... 347/10

FOREIGN PATENT DOCUMENTS

JP 10-081012 A 3/1998
JP 2005-212411 A 8/2005

* cited by examiner

*Primary Examiner* — Lam S Nguyen
(74) *Attorney, Agent, or Firm* — McDermott Will & Emery LLP

(57) ABSTRACT

In an inkjet printer, an ejecting part for K color is previously selected as an ejecting part for outputting three values used for formation of a large dot, formation of a medium dot, and non-ejection (step S12). In the course of image recording (steps S13, S14, and S15), three values are output regarding K color, and four values used for formation of a large dot, formation of a medium dot, formation of a small dot, and non-ejection are output regarding C, M, and Y colors. Thus, even if the quality of a dot in K color is reduced at the time of outputting four values, a high-quality dot can be formed regarding K color, so that the quality of a recorded image can be improved in a case where line drawing or a character or the like is recorded.

20 Claims, 9 Drawing Sheets

INKJET PRINTER AND IMAGE RECORDING METHOD

TECHNICAL FIELD

The present invention relates to an inkjet printer for recording an image on an object, and to an image recording method adopted in an inkjet printer.

BACKGROUND ART

Conventionally, an inkjet printer which includes a head having a plurality of outlets and controls ejection of fine droplets of ink from each of the outlets while moving the head relatively to an object, to thereby record an image, has been used. In such inkjet printer, ejection of droplets is accomplished by input of an ejection pulse to a piezoelectric element provided in the neighborhood of each outlet of the head, for example. According to a method disclosed in Japanese Patent Application Laid-Open No. 10-81012, a driving signal output per printing cycle consists of four driving pulses of a first pulse, a second pulse, a third pulse, and a fourth pulse, and a diameter of a dot recorded on a recording paper is variably controlled by appropriately selecting one or some of the driving pulses, to thereby achieve multiple tone printing.

Also, according to a method disclosed in Japanese Patent Application Laid-Open No. 2005-212411, a gentle vibration signal which vibrates meniscus in a nozzle so gently that ejection of ink in channels from the nozzle can be avoided is continuously applied to all channels regardless of presence or absence of image data, and an ink ejection signal is generated by including therein the gentle vibration signal depending on image data, to thereby constantly record a high-quality image with high reliability.

Meanwhile, in recent years, there is a demand for high-speed recording of an image, so that a cycle for input of a driving signal to a head is becoming shorter. Along with this, limitations are put to a waveform of an ejection pulse which causes ejection of a droplet in a driving signal, and thus, in some cases, it is difficult to form a dot of a desired size by using only one ejection pulse. While there is an approach of using a combination of a plurality of ejection pulses to form a dot of a desired size, use of a plurality of ejection pulses in forming dots of respective sizes results in increase in the number of ejection pulses included in a driving signal. Accordingly, the driving signal becomes too long to cope with speed enhancement in image recording. As a result, the quality of an image is reduced.

SUMMARY OF INVENTION

The present invention is directed to an inkjet printer, and it is an object of the present invention to enhance the quality of an image which is to be recorded.

An inkjet printer according to one preferred embodiment of the present invention, includes: a recording part for ejecting droplets of ink from an outlet toward an object, to form dots on the object; a moving mechanism for moving the object relatively to the recording part in a moving direction; and a controller for sequentially inputting signals to the recording part, the signals being instructions for ejection of droplets, in parallel with movement of the object relative to the recording part, wherein the recording part includes: a first ejecting part which ejects ink in a first color and is capable of forming dots of m or more different sizes, m being an integer equal to or more than two; and a second ejecting part which ejects ink in a second color different from the first color, and is capable of forming dots of the m or more different sizes, the first ejecting part forms dots of the m different sizes and the second ejecting part forms dots of n different sizes included in the m different sizes, n being an integer equal to or more than one and smaller than m, and a driving signal used for forming a dot of at least one size included in the n different sizes by the first ejecting part and a driving signal used for forming a dot of the at least one size by the second ejecting part are different from each other.

In an inkjet printer according to another preferred embodiment of the present invention, a driving signal including a minute pulse used at the time when the first ejecting part ejects no droplet and a driving signal including a minute pulse used at the time when the second ejecting part ejects no droplet are different from each other.

Preferably, m is three, and n is two.

According to the present invention, by differentiating the number of sizes of dots in at least one color from the number of sizes of dots in the other colors, it is possible to improve the quality of a recorded image.

The present invention is also directed to an image recording method being executed in an inkjet printer.

These and other objects, features, aspects and advantages of the present invention will become more apparent from the following detailed description of the present invention when taken in conjunction with the accompanying drawings.

BRIEF DESCRIPTION OF DRAWINGS

Figure 1:
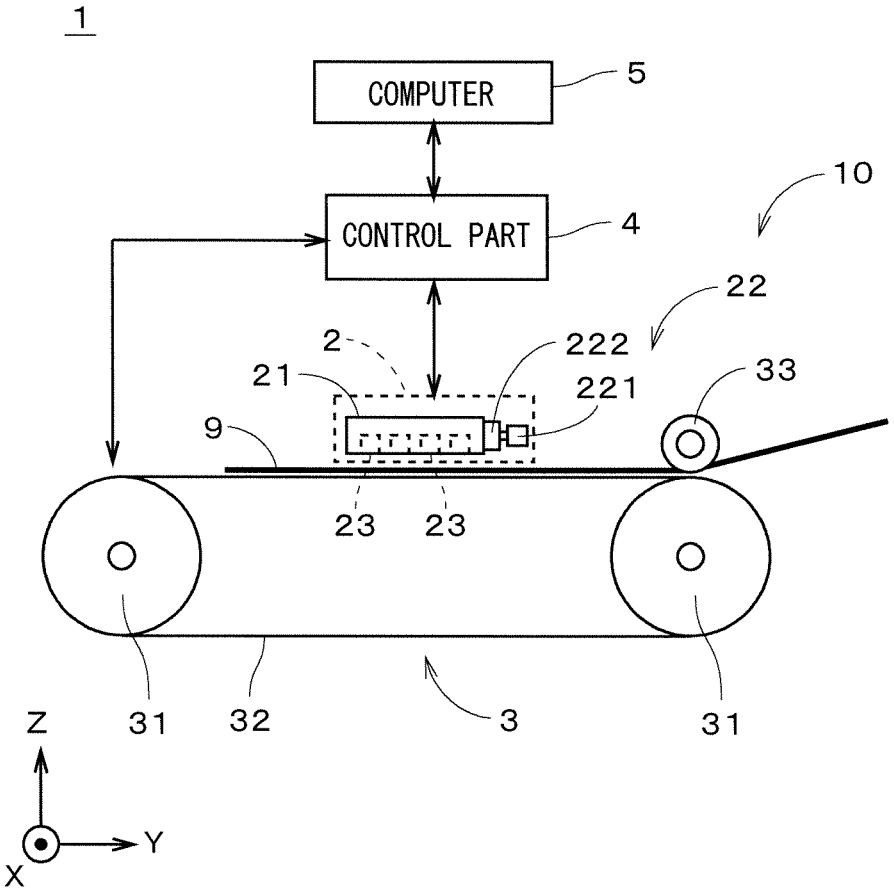
FIG. 1 illustrates a structure of an inkjet printer.

FIG. 1 illustrates a structure of an inkjet printer 1 according to a preferred embodiment of the present invention. The inkjet printer 1 includes a body 10 and a computer 5 connected with the body 10. The body 10 includes a recording part 2 for ejecting fine droplets of ink toward a recording paper 9, a paper feeding mechanism 3 for feeding the recording paper 9 in the (−Y) direction in FIG. 1 under the recording part 2 (on the (−Z) side of the recording part 2), and a control part 4 connected with the recording part 2 and the paper feeding mechanism 3.

The paper feeding mechanism 3 includes two belt rollers 31 connected with a motor not illustrated, and a belt 32 laid on the two belt rollers 31. Each region in the recording paper 9 which is a continuous paper is guided onto the belt 32 via a roller 33 provided above one of the belt rollers 31 which is placed on the (+Y) side, held on the belt 32, and moved toward the (−Y) side, passing a space under the recording part 2, together with the belt 32. Also, an encoder 34 (refer to FIG. 3) is provided in the belt rollers 31 of the paper feeding mechanism 3. In the following description, the direction of movement (i.e., moving direction) of the recording part 2 relative to the recording paper 9 (the Y-direction) will be referred to as a scanning direction. Meanwhile, in the paper feeding mechanism 3, a suction part may be provided at a position facing the recording part 2 in the inner side of the ring-shaped belt 32. In such suction part, minute suction holes are formed in the belt 32 so that the recording paper 9 can be held on the belt 32 by suction and absorption.

The recording part 2 includes a head unit 21 including a plurality (four in the preferred embodiment) of heads 23. The plurality of heads 23 eject ink in cyan (C), magenta (M), yellow (Y), and black (K), respectively, and are arranged in the Y-direction. Though one head 23 ejects ink in one color in the preferred embodiment, units for ejecting respective colors are not necessarily in one-to-one correspondence with the heads 23. In other words, one head may eject ink in several colors, and several heads may eject ink in the same one color. In the following description, a mechanism for ejecting ink in one color will be referred to as an "ejecting part", and an ejecting part will be denoted with a reference numeral "23" because the head 23 corresponds to an ejecting part in the preferred embodiment.

Figure 2:
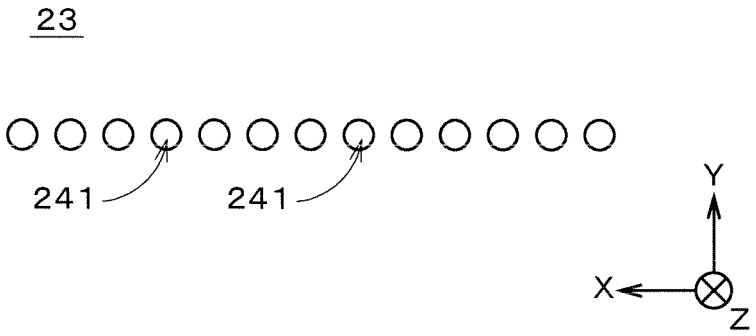
FIG. 2 is a bottom plan view of a head.

FIG. 2 is a bottom plan view illustrating a part of one of ejecting parts 23. In FIG. 2, the scanning direction of the recording part 2 relative to the recording paper 9 (i.e., the Y-direction) is vertically illustrated. In a bottom surface of each of the ejecting parts 23, a plurality of outlets 241 are formed and arranged with a predetermined pitch in a direction which is perpendicular to the scanning direction and goes along the recording paper 9 (the direction is the X-direction in FIG. 1 and corresponds with a width of the recording paper 9 so that the direction will be also referred to as a "width direction" in the following description). The plurality of outlets 241 are not necessarily arranged linearly so long as a predetermined pitch is kept in the width direction.

A piezoelectric element 232 (refer to FIG. 3) is provided for each of the outlets 241 in the ejecting parts 23. Thus, to drive the piezoelectric element 232 causes ejection of a droplet of ink from the outlet 241 toward the recording paper 9. In practice, by controlling drive of the piezoelectric element 232, droplets in different amounts can be ejected from the outlets 241. As a result of this, a dot of a small size, a dot of a medium size, and a dot of a large size can be formed on the recording paper 9 (in the following description, those dots will be referred to as a "small dot", a "medium dot", and a "large dot", respectively). The plurality of outlets 241 are arranged to cover the whole width of a recording area of the recording paper 9 in the width direction. Thus, in the inkjet printer 1, by only one-time passage of the recording paper 9 under the recording part 2 (so-called single-pass printing), image recording can be completed in a short period of time.

Further, the recording part 2 in FIG. 1 includes a head moving mechanism 22 which moves the head unit 21 in the width direction. The head moving mechanism 22 includes a ring-shaped timing belt 222 which is slim and has a longer side along the width direction. The timing belt 222 is rotated by the motor 221, so that the head unit 21 smoothly moves in the width direction. At the time of non-recording in the inkjet printer 1, the head moving mechanism 22 places the head unit 21 at a predetermined stand-by position, where the plurality of outlets 241 of each of the ejecting parts 23 are covered with lid materials, to prevent the outlets 241 from being clogged because of drying of ink in the neighborhood of the outlets 241.

Figure 3:
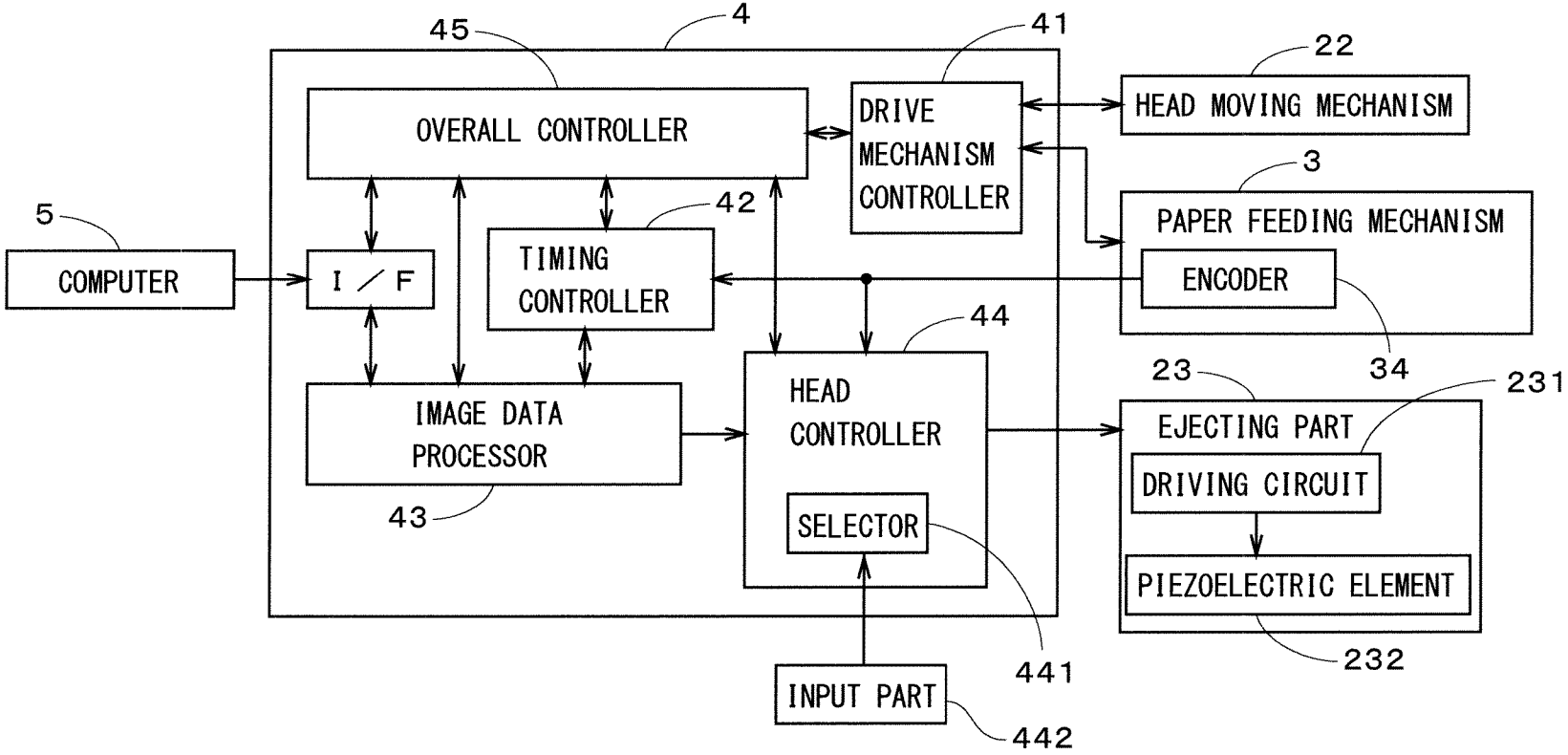
FIG. 3 is a functional block diagram illustrating functions of the inkjet printer.

FIG. 3 is a functional block diagram of the inkjet printer 1. The control part 4 includes a drive mechanism controller 41 for controlling drive of the head moving mechanism 22 and the paper feeding mechanism 3, a timing controller 42 which receives an encoder signal from the encoder 34 of the paper feeding mechanism 3 and controls the time when droplets are ejected from the outlets 241 of the ejecting parts 23, an image data processor 43 for receiving original image data which is to be recorded from the computer 5 via an interface (I/F) and generating drawing data for the ejecting parts 23 by using the received original image data, a head controller 44 which is connected with the ejecting parts 23 and controls the ejecting parts 23 based on the drawing data, and an overall controller 45 responsible for overall control of the control part 4. It is noted that though only one ejecting part 23 is illustrated in FIG. 3 for the sake of convenience in illustration, a signal is input to each of the plurality of ejecting parts 23 from the head controller 44 in practice. Since the ejecting part 23 is a part of the recording part 2, the structure of the ejecting part 23, the operations of the ejecting part 23, and input of a signal to the ejecting part 23 are equivalent to the structure of the recording part 2, the operations of the recording part 2, and input of a signal to the recording part 2.

In the ejecting part 23, a driving circuit 231 is provided for each of the respective piezoelectric elements 232 of the plurality of outlets 241, and signals which give instructions for ejecting droplets are sequentially input to the driving circuits 231 from the head controller 44. It is noted that in FIG. 3, only one driving circuit 231 and only one piezoelectric element 232 are illustrated.

In the inkjet printer 1, the ejecting part 23 for ejecting ink in C, M, and Y (which will be hereinafter referred to as a first ejecting part 23*a*") forms a large dot, a medium dot, and a small dot on the recording paper 9. Thus, the first ejecting part 23*a* receives instruction values (four tone values of dots) which give instructions for output of four values which give instructions for formation of a large dot, formation of a medium dot, formation of a small dot, and formation of no dot, respectively, from the head controller 44. The four instruction values serve also as instruction values for forming three different sizes of dots. On the other hand, the ejecting part 23 for ejecting ink in K (which will be hereinafter referred to as a "second ejecting part 23*b*") forms a large dot and a medium dot on the recording paper 9. Thus, the second ejecting part 23*b* receives instruction values (three tone values of dots) which give instructions for output of three values which give instructions for formation of a large dot, formation of a medium dot, and formation of no dot, from the head controller 44. The three instruction values serve also as instruction values for forming two different sizes of dots.

The head controller 44 includes a selector 441, and the selector 441 is connected with an input part 442. The selector 441 selects the ejecting part 23 which outputs three values, from the plurality of ejecting parts 23. The input part 442 receives instructions to the selector 441 provided by a user. The input part 442 may be a part of the computer 5.

Figure 4:
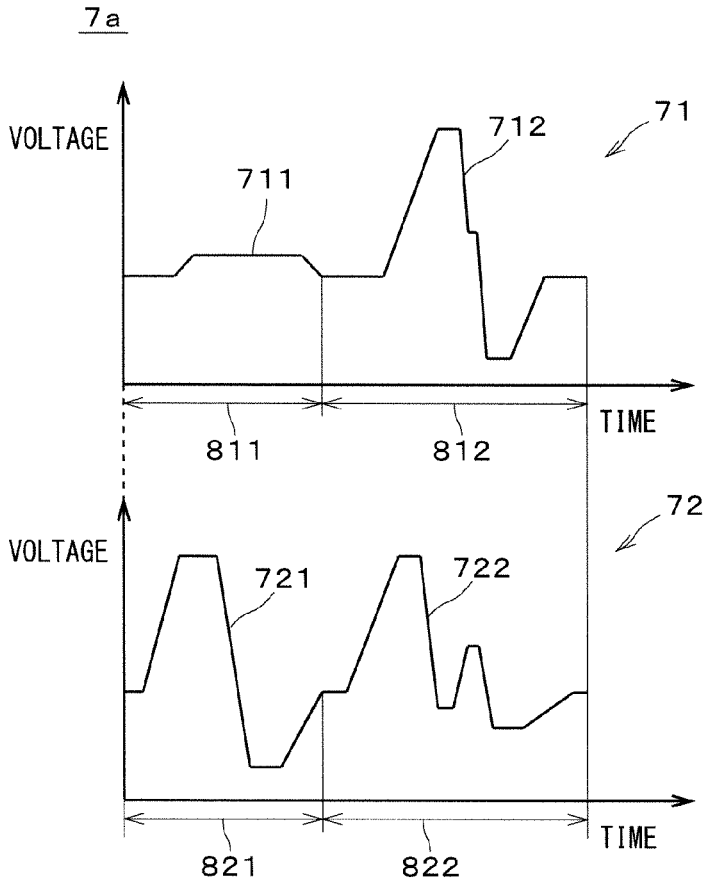
FIG. 4 illustrates a first basic waveform.

FIG. 4 illustrates a first basic waveform 7*a* generated in the head controller 44. The first basic waveform 7*a* is used for output of the foregoing four values. In each of an upper area and a lower area in FIG. 4, a vertical axis represents a voltage and a horizontal axis represents time. The first basic waveform 7*a* consists of two waveform-element sequences 71 and 72, and the waveform-element sequence 71 in the upper area of FIG. 4 and the waveform-element sequence 72 in the lower area of FIG. 4 are generated in parallel with each other. The waveform-element sequence 71 in the upper area includes two pulses 711 and 712, and respective time durations of those pulses are denoted with reference numerals "811" and "812". The waveform-element sequence 72 in the lower area includes two pulses 721 and 722, and respective time durations of those pulses are denoted with reference numerals "821" and "822". The starting time of the duration 812 and the starting time of the duration 822 coincide with each other. A voltage at a starting position and an ending portion of each pulse is a constant reference voltage.

Each of the pulses serves to cause the piezoelectric element 232 to perform at least a part of a series of operations. The pulse 712 in the upper area and the pulses 721 and 722 in the lower area are used for ejection of a droplet, and each of the foregoing pulses is great enough to solely cause ejection of a droplet from the outlet 241. In the following description, the foregoing pulses will be referred to as a "first ejection pulse 712", a "second ejection pulse 721", and a "third ejection pulse 722", respectively. The pulse 711 in the upper area is a minute pulse which is too small to solely cause ejection of a droplet in principle, and that pulse will be hereinafter referred to as a "minute pulse 711". The maximum value of a difference between the reference voltage and a minute pulse is smaller than the maximum value of a difference between the reference voltage and an ejection pulse.

The head controller 44 repeatedly provides the basic waveform 7*a* and a control signal for selecting a pulse(s), to the driving circuit 231. The driving circuit 231 selects a pulse(s), so that a driving signal is repeatedly provided to the corresponding piezoelectric element 232. Thus, the length of the basic waveform 7*a* is equal to a driving cycle of the driving circuit 231. More specifically, the head controller 44 repeatedly provides the waveform-element sequences 71 and 72 to the driving circuit 231, and in parallel therewith, provides a control signal attaching "1" to a pulse which should be selected and attaching "0" to a pulse which should not be selected, to the driving circuit 231. In the driving circuit 231, pulses to which "1" are attached are extracted from the two waveform-element sequences 71 and 72 and combined, to generate a driving signal.

Figure 5:
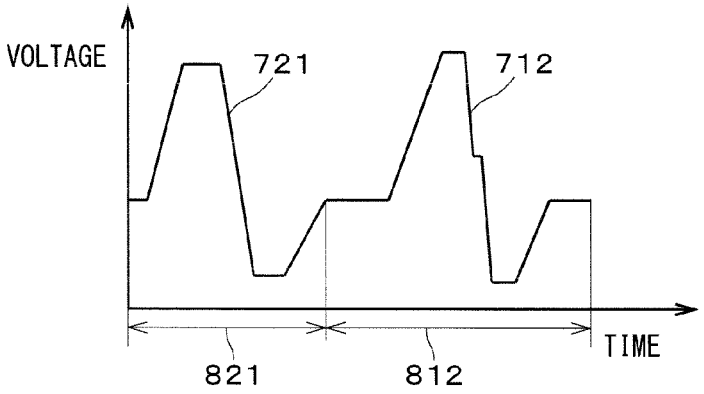
FIG. 5 illustrates a driving signal used for a large dot.

For example, to the driving circuit 231 which ejects a droplet (alternatively, a collection of droplets) used for a large dot, the two waveform-element sequences 71 and 72 are input, and further, a control signal which indicates "1" only in the duration 821 is input, regarding the waveform-element sequence 72 in the lower area in FIG. 4. Accordingly, only the second ejection pulse 721 is extracted from the waveform-element sequence 72. Regarding the waveform-element sequence 71 in the upper area, a control signal which indicates "1" only in the duration 812 is input, so that the first ejection pulse 712 is extracted from the waveform-element sequence 71. As a result, in the driving circuit 231, a driving signal which includes the second ejection pulse 721 and the first ejection pulse 712 arranged in this order as illustrated in FIG. 5 is generated, and the thus generated driving signal is input to the corresponding piezoelectric element 232.

In the outlet 241, ejecting operation of a droplet in association with the second ejection pulse 721 is made in advance, and subsequently, ejecting operation of a droplet in association with the first ejection pulse 712 is made, so that a large dot is formed on the recording paper 9. It is noted that each of the number of droplets ejected in association with the second ejection pulse 721 and the number of droplets ejected in association with the first ejection pulse 712 is not limited to one.

Figure 6:
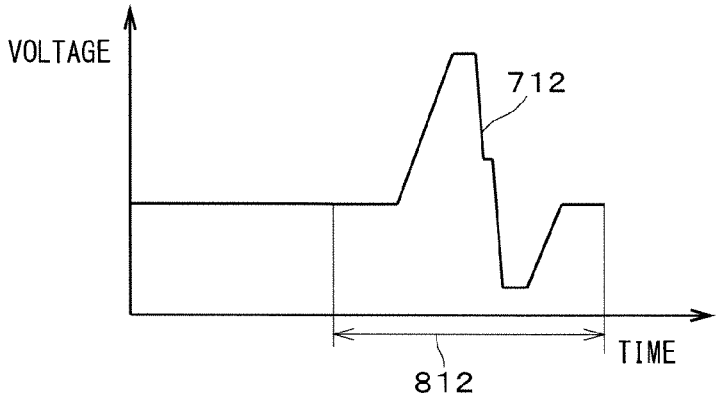
FIG. 6 illustrates a driving signal used for a medium dot.

To the driving circuit 231 which ejects a droplet used for a medium dot, the two waveform-element sequences 71 and 72 are input, and further, a control signal which indicates "1" only in the duration 812 regarding the waveform-element sequence 71 in the upper area in FIG. 4, and a control signal which indicates "0" in all the durations in the waveform-element sequence 72 in the lower area, are input. Accordingly, a driving signal formed by extracting the first ejection pulse 712 from the waveform-element sequence 71 as illustrated in FIG. 6 is generated. At all times except for the duration 812, the reference voltage is maintained. In the outlet 241, ejection of a droplet in association with the first ejection pulse 712 is made, so that a medium dot is formed on the recording paper 9.

Figure 7:
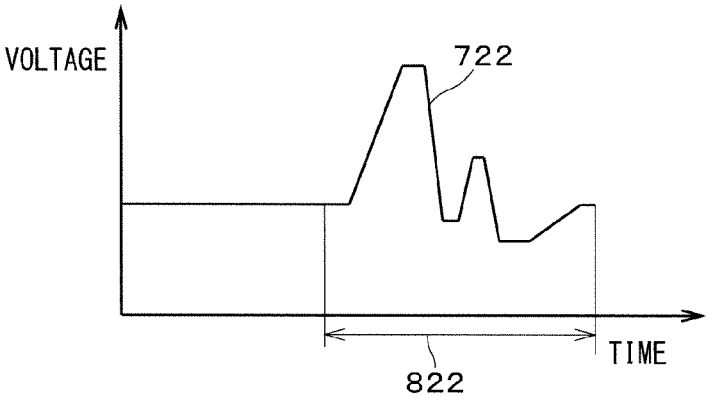
FIG. 7 illustrates a driving signal used for a small dot.

To the driving circuit 231 which ejects a droplet used for a small dot, the two waveform-element sequences 71 and 72 are input, and further, a control signal which indicates "0" in all the durations in the waveform-element sequence 71 in the upper area in FIG. 4, and a control signal which indicates "1" only in the duration 822 regarding the waveform-element sequence 72 in the lower area, are input. Accordingly, a driving signal formed by extracting the third ejection pulse 722 from the waveform-element sequence 72 as illustrated in FIG. 7 is generated. At all times except for the duration 822, the reference voltage is maintained. In the outlet 241, ejection of a droplet in association with the third ejection pulse 722 is made, so that a small dot is formed on the recording paper 9.

Figure 8:
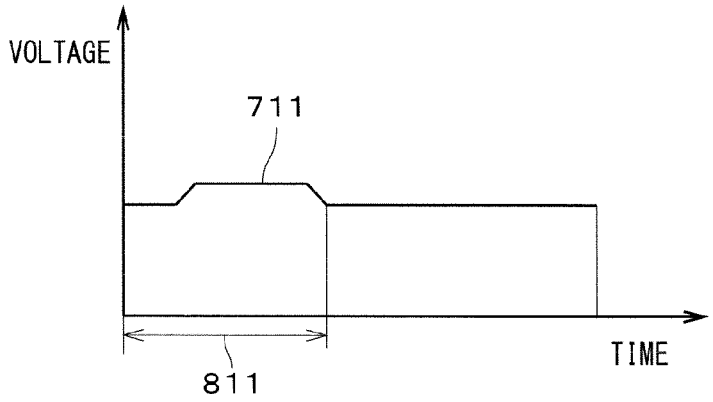
FIG. 8 illustrates a driving signal used at the time of non-ejection.

To the driving circuit 231 which ejects no droplet in the course of one cycle of the first basic waveform 7*a*, the two waveform-element sequences 71 and 72 are input, and further, a control signal which indicates "1" only in the duration 811 regarding the waveform-element sequence 71 in the upper area in FIG. 4, and a control signal which indicates "0" in all the durations in the waveform-element sequence 72 in the lower area, are input. Accordingly, a driving signal formed by extracting the minute pulse 711 from the waveform-element sequence 71 as illustrated in FIG. 8 is generated. At all times except for the duration 811, the reference voltage is maintained. In the outlets 241, only gentle vibration of liquid surfaces is caused by the minute pulse 711, as a non-ejection operation. Because of the gentle vibration, ink in the neighborhood of the outlet 241 is prevented from being hardened.

As is made clear from the above description, though an ultimate driving signal for driving the piezoelectric element 232 is generated in the driving circuit 231, an understanding that the head controller 44 substantially provides a driving signal to the driving circuit 231 of the ejecting part 23 is reasonable because the basic waveform and a control signal provided from the head controller 44 are equivalent to a driving signal.

Figure 9:
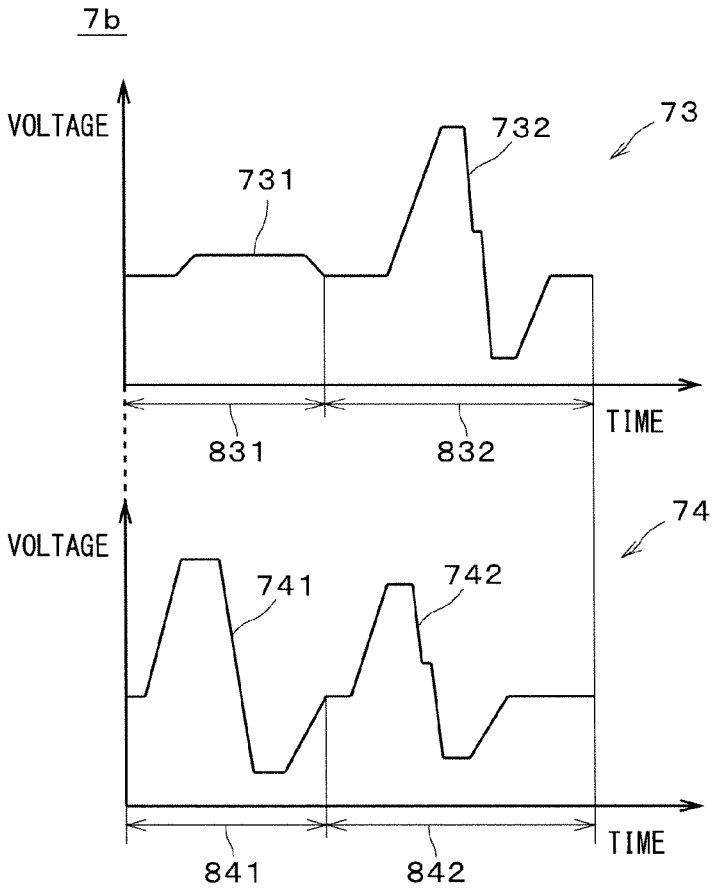
FIG. 9 illustrates a second basic waveform.

FIG. 9 illustrates a second basic waveform 7*b* generated in the head controller 44. The second basic waveform 7*b* is used for giving instructions for output of the above-described three values. The second basic waveform 7*b* consists two waveform-element sequences 73 and 74, and the waveform-element sequence 73 in the upper area of FIG. 9 and the waveform-element sequence 74 in the lower area of FIG. 9 are generated in parallel with each other. The waveform-element sequence 73 in the upper area includes two pulses 731 and 732, and respective time durations of those pulses are denoted with reference numerals "831" and "832". The waveform-element sequence 74 in the lower area includes two pulses 741 and 742, and respective time durations of those pulses are denoted with reference numerals "841" and "842". The starting time of the duration 832 and the starting time of the duration 842 coincide with each other. A voltage at a starting position and an ending portion of each pulse is a constant reference voltage. The length of the second basic waveform 7*b* is equal to the length of the first basic waveform 7*a*, and corresponds to a driving cycle of the driving circuit 231.

As is the case with FIG. 4, the pulse 732 in the upper area and the pulses 741 and 742 in the lower area in FIG. 9 are used for ejection of droplets, and each of those pulses is great enough to solely cause ejection of a droplet from the outlets 241. In the following description, those pulses will be referred to as a "first ejection pulse 732", a "second ejection pulse 741", and a "third ejection pulse 742", respectively. The pulse 731 in the upper area in FIG. 9 is too small to solely cause ejection of a droplet in principle, and will be referred to as a "minute pulse 731" in the following description.

To the driving circuit 231 which ejects a droplet for a large dot with the use of the second basic waveform 7*b*, the two waveform-element sequences 73 and 74 are input, and further, a control signal which indicates "1" only in the duration 841 is input, regarding the waveform-element sequence 74 in the lower area in FIG. 9, in the same manner as in FIG. 5. Accordingly, the second ejection pulse 741 is extracted from the waveform-element sequence 74. Regarding the waveform-element sequence 73 in the upper area, a control signal which indicates "1" only in the duration 832 is input, so that the first ejection pulse 732 is extracted from the waveform-element sequence 73. As a result, in the driving circuit 231, a driving signal which includes the second ejection pulse 741 and the first ejection pulse 732 arranged in this order is generated, and the thus generated driving signal is input to the corresponding piezoelectric element 232.

In the outlet 241, ejecting operation of a droplet in association with the second ejection pulse 741 is made in advance, and subsequently, ejecting operation of a droplet in association with the first ejection pulse 732 is made, so that a large dot is formed on the recording paper 9. It is noted that each of the number of droplets ejected in association with the second ejection pulse 741 and the number of droplets ejected in association with the first ejection pulse 732 is not limited to one.

Figure 10:
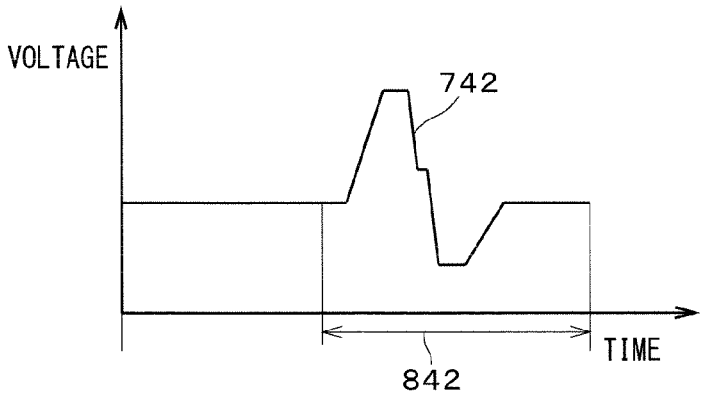
FIG. 10 illustrates a driving signal used for a medium dot.

To the driving circuit 231 which ejects a droplet used for a medium dot, the two waveform-element sequences 73 and 74 are input, and further, a control signal which indicates "0" in all the durations in the waveform-element sequence 73 in the upper area in FIG. 9 is input. Regarding the waveform-element sequence 74 in the lower area, a control signal which indicates "1" only in the duration 842 is input. Accordingly, a driving signal formed by extracting the third ejection pulse 742 from the waveform-element sequence 74 as illustrated in FIG. 10 is generated. At all times except for the duration 842, the reference voltage is maintained. In the outlet 241, ejection of a droplet in association with the third ejection pulse 742 is made, so that a medium dot is formed on the recording paper 9.

To the driving circuit 231 which ejects no droplet in the course of one cycle of the second basic waveform 7*b*, the two waveform-element sequences 73 and 74 are input, and further, a control signal which indicates "1" only in the duration 831 regarding the waveform-element sequence 73 in the upper area in FIG. 9, and a control signal which indicates "0" in all the durations in the waveform-element sequence 74 in the lower area, are input in the same manner as in FIG. 8. Accordingly, a driving signal formed by extracting the minute pulse 731 from the waveform-element sequence 73 is generated. At all times except for the duration 831, the reference voltage is maintained. In the outlets 241, only gentle vibration of liquid surfaces is caused by the minute pulse 731, as a non-ejection operation.

Figure 11:
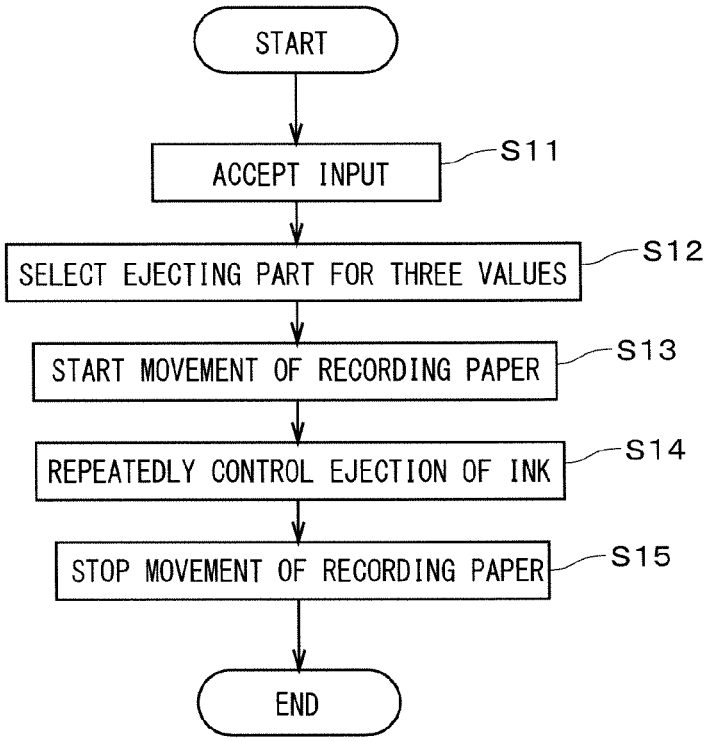
FIG. 11 is a flow chart illustrating a process of recording an image.

FIG. 11 is a flow chart illustrating a process performed in the inkjet printer 1 for recording an image on the recording paper 9. As a preparation, settings which allow output of four values from the first ejecting part 23*a* for ejecting colors of C, M, and Y and output of three values from the second ejecting part 23*b* for ejecting a color of K are accepted via the input part 442 (step S11). For example, in a case where each of the ejecting parts 23 outputs four values in initial states thereof, instructions for outputting three values for K color are input. Then, the selector 441 selects the ejecting part 23 for ejecting K color as an ejecting part assigned to output of three values, in accordance with the instructions given by the input part 442 (step S12). Additionally, since in many cases, output of three values is needed depending on the type of ink, it is preferable that the input part 442 accepts input of the type of ink for use and the selector 441 selects the ejecting part 23 for outputting three values, that is, the ejecting part 23 for forming dots of two sizes, in accordance with the type of ink as input.

During operations for recording an image, first, the drive mechanism controller 41 drives the head moving mechanism 22, so that the head unit 21 in FIG. 1 is moved from a standby position to a predetermined recording position in the X direction. Subsequently, upon drive of the paper feeding mechanism 3, continuous movement of the recording paper 9 is started (step S13). In parallel with the movement of the recording paper 9 relative to the recording part 2, the head controller 44 in FIG. 3 sequentially inputs the first basic waveform 7*a* and a control signal which give instructions for ejection of a droplet, to the first ejecting part 23*a*, and also sequentially inputs the second basic waveform 7*b* and a control signal to the second ejecting part 23*b*. As a result, a part of a plurality of waveform elements included in the basic waveforms 7*a* and 7*b* is selected, and driving signals used for ejection of droplets are generated in the driving circuits 231 and are provided to the piezoelectric elements 232, so that ink is repeatedly ejected (step S14).

More specifically, in the first ejecting part 23*a*, a control signal which gives instructions for output of any of four values for forming a large dot, forming a medium dot, forming a small dot, and non-ejecting, respectively, is input to each of the driving circuits 231, and held. On the other hand, every time the recording paper 9 travels a predetermined distance in the scanning direction, an ejection timing signal is generated by the timing controller 42 based on an output provided from the encoder 34. In the first ejecting part 23*a*, in synchronization with the ejection timing signal, each of the plurality of driving circuits 231 selects a waveform element from the first basic waveform 7*a* in accordance with the control signal, to generate a driving signal, and provides the generated driving signal to the piezoelectric element 232. As a result, ejection of ink is achieved in each of the plurality of outlets 241 with desired timing. In the second ejecting part 23*b*, a control signal which gives instructions for output of any of three values for forming a large dot, forming a medium dot, and non-ejecting, respectively, is input to each of the driving circuits 231, and held. Each of the plurality of driving circuits 231 in the second ejecting part 23*b* generates a driving signal from the second basic waveform 7*b* in accordance with the control signal in synchronization with the ejection timing signal, and provides the generated driving signal to the piezoelectric element 232. Then, in the course of image recording, the foregoing process is repeatedly performed at high speed.

When an entirety of an image indicated by the original image data which is to be recorded is recorded on the recording paper 9 in the above-described manner, the movement of the recording paper 9 is stopped, to complete an image recording process of the inkjet printer 1 (step S15).

In the meantime, in the inkjet printer 1, to achieve output of four values, a driving signal for a large dot employs the second ejection pulse 721 and the first ejection pulse 712, and a driving signal for a medium dot employs the first ejection pulse 712. Then, the waveform of the first ejection pulse 712 for a medium dot should be determined, taking both of formation of a large dot and formation of a medium dot, into account. However, there arises various constraints to a basic waveform because of increase in speed of image recording, and thus it is difficult to determine the waveform of the first ejection pulse 712 for forming an appropriate medium dot. Thus, if the waveform for a large dot is preferentially determined, for example, there is a possibility of reducing the quality of a medium dot because of cracking of a dot, attachment of a minute dot, or the like. Reduction of the quality of a dot, if it occurs in K color when recording line drawing or characters or the like, would lead to reduction of the quality of a whole image.

In contrast thereto, in the inkjet printer 1, the second ejecting part 23*b* for ejecting K color outputs only three values, and neither the first ejection pulse 712 nor the second ejection pulse 721 is used in forming a medium dot. As a result, it is possible to easily attain a driving signal for forming an appropriate medium dot, so that the quality of an image which is to be recorded can be improved.

Figure 12:
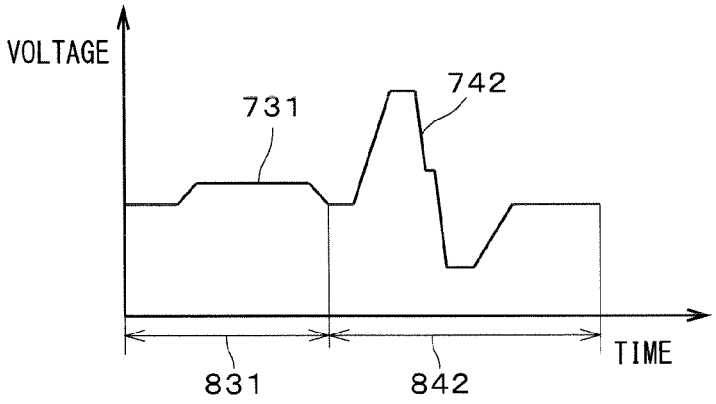
FIG. 12 illustrates another driving signal used for a medium dot.

FIG. 12 illustrates another example of a driving signal used for forming a medium dot, for the second ejecting part 23*b*. The driving signal illustrated in FIG. 12 includes the minute pulse 731 and the third ejection pulse 742 in the second basic waveform 7*b*. In this way, to use the third ejection pulse 742 in combination with the minute pulse 731 could make it possible to more easily achieve appropriate ejection by adjusting the waveform of the minute pulse 731.

Figure 13:
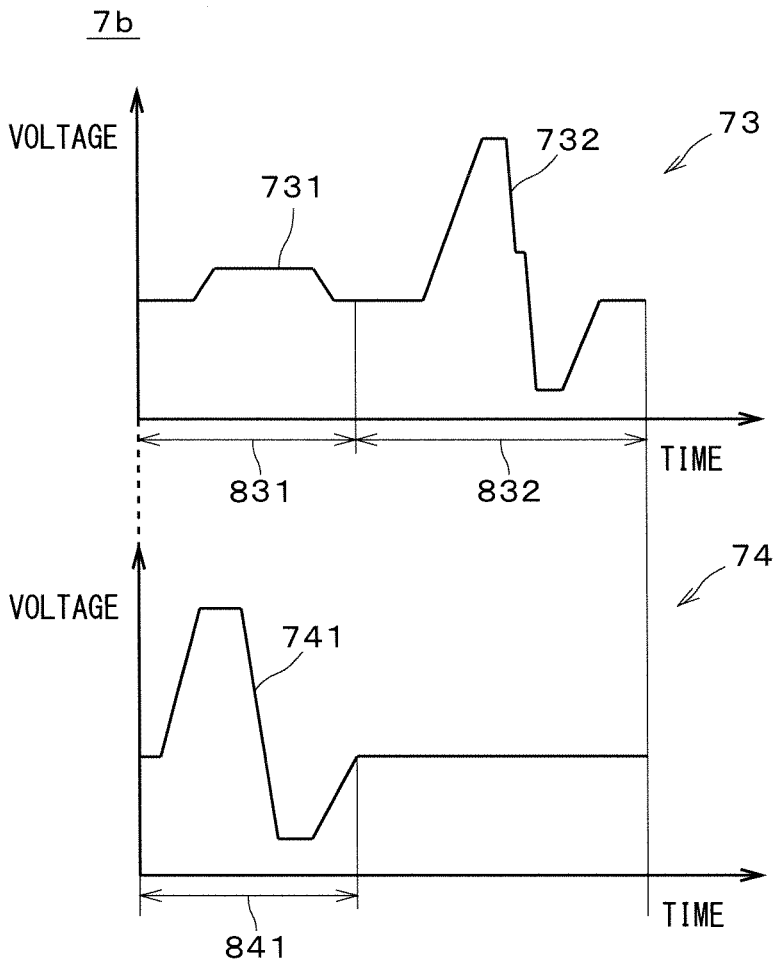
FIG. 13 illustrates another example of the second basic waveform.

FIG. 13 illustrates another example of the second basic waveform 7*b*. The second basic waveform 7*b* in FIG. 13, as compared with that in FIG. 9, includes the minute pulse 731 having a different waveform and does not include the third ejection pulse 742. The second basic waveform 7*b* in FIG. 13 is identical to that in FIG. 9 in the other respects than described above.

In a case where the second basic waveform 7*b* illustrated in FIG. 13 is used, the second ejection pulse 741 and the first ejection pulse 732 are selected for forming a large dot, and a driving signal similar to that in FIG. 5 is generated. For forming a medium dot, only the first ejection pulse 732 is selected, and a driving signal similar to that in FIG. 6 is generated. At the time of non-ejection, only the minute pulse 731 is selected, to generate a driving signal. That is, when comparison is made between a case where four values are output and a case where three values are output, the same driving signal is generated for forming a large dot, the same driving signal is generated for forming a medium dot, and different driving signals are generated at the time of forming no dot.

In each of the ejecting parts 23, driving signals are input to the plurality of driving circuits 231 in parallel. Thus, a driving signal used at the time of non-ejection slightly affects ejection from the other outlets 241. Then, in the inkjet printer 1, the first ejecting part 23*a* for ejecting a droplet for a small dot and the second ejecting part 23*b* which does not eject any droplet for a small dot are so designed that respective driving signals treated at the time of non-ejection are different from each other, to thereby achieve appropriate ejection in both of the first and second ejecting parts 23*a* and 23*b*.

The above-described techniques are suitable for a case, for example, where there is a limit to what output of four values can do in improving the quality of a dot, and by outputting three values for an important color in an image such as K color and adjusting the form of a minute pulse, the quality of dots of respective sizes obtained by output of three values can be improved as compared to the quality of dots obtained by output of four values. Only a difference in driving signals treated at the time of non-ejection makes it possible to easily attain an appropriate driving signal.

As is made clear from the above description, in the inkjet printer 1, three values are output for K color and four values are output for each of the other colors, so that reduction of the recording quality of monochrome line drawing or character images or the like can be prevented, in other words, the recording quality of monochrome line drawing or character images or the like can be improved. Also, by outputting four values for each of C, M, and Y, the image quality of a colored picture can be improved. Further, since each of the basic waveforms 7*a* and 7*b* consists of two waveform-element sequences, a driving cycle can be considerably shortened. A short basic waveform is suitable for an inkjet printer for recording an image at high speed, and particularly suitable for an inkjet printer for achieving image recording by single-pass printing.

Figure 14:
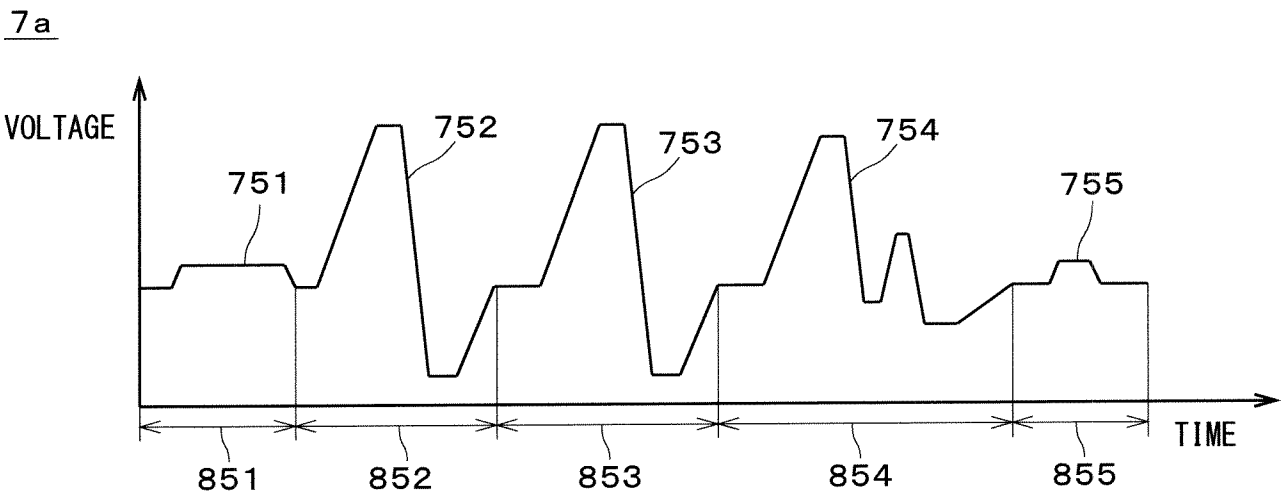
FIG. 14 illustrates another example of the first basic waveform.
Figure 15:
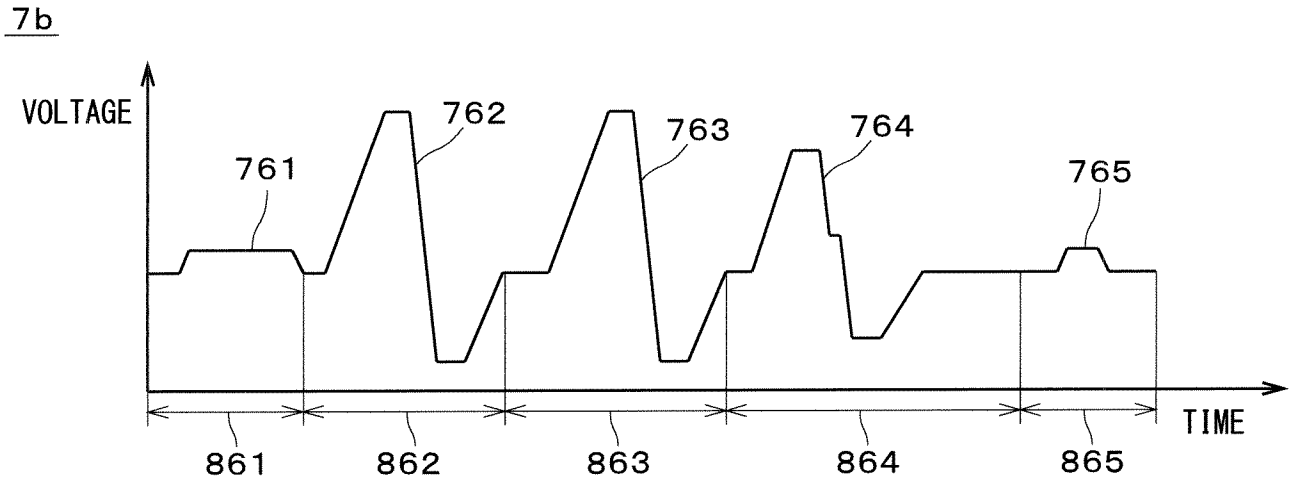
FIG. 15 illustrates another example of the second basic waveform.

FIG. 14 illustrates another example of the first basic waveform 7*a*, and FIG. 15 illustrates another example of the second basic waveform 7*b*. The second basic waveform 7*b* is used by the second ejecting part 23*b* for ejecting ink in K color, and the first basic waveform 7*a* is used by the first ejecting part 23*a* for ejecting ink in the other colors.

Each of the basic waveforms 7*a* and 7*b* illustrated in FIGS. 14 and 15, respectively, is one waveform-element sequence. The first basic waveform 7*a* includes a minute pulse 751, a first ejection pulse 752, a second ejection pulse 753, a third ejection pulse 754, and an auxiliary minute pulse 755 which are arranged in the order cited. Respective time durations of those pulses are denoted with reference numerals, "851" to "855", respectively. As for a driving signal, in generating a driving signal for a large dot, for example, the first ejection pulse 752, the second ejection pulse 753, and the auxiliary minute pulse 755 are selected. In generating a driving signal for a medium dot, the second ejection pulse 753 and the auxiliary minute pulse 755 are selected. In generating a driving signal for a small dot, the third ejection pulse 754 and the auxiliary minute pulse 755 are selected. In generating a driving signal used at the time of non-ejection, the minute pulse 751 is selected.

Also, the second basic waveform 7*b* includes a minute pulse 761, a first ejection pulse 762, a second ejection pulse 763, a third ejection pulse 764, and an auxiliary minute pulse 765 which are arranged in the order cited. Respective time durations of those pulses are denoted with reference numerals, "861" to "865", respectively. As for a driving signal, in generating a driving signal for a large dot, for example, the first ejection pulse 762, the second ejection pulse 763, and the auxiliary minute pulse 765 are selected. In generating a driving signal for a medium dot, the third ejection pulse 764 and the auxiliary minute pulse 765 are selected. In generating a driving signal used at the time of non-ejection, only the minute pulse 761 is selected.

By the foregoing operations, in the inkjet printer 1, the second ejecting part 23*b* for ejecting ink in K color outputs only three values, and neither the first ejection pulse 762 nor the second ejection pulse 763 is used for forming a medium dot as is the case with FIGS. 4 and 9. As a result, it is possible to easily attain a driving signal for forming an appropriate medium dot. Also, inclusion of the auxiliary minute pulses 755 and 756 suppresses residual vibration in liquid surfaces in the outlets 241 after ejection of droplets, so that operations for the next ejection can be performed in a stable situation.

Also in a case where the basic waveform is one waveform-element sequence, as is the case with the example illustrated in FIG. 13, driving signals may be designed such that respective driving signals for a large dot and a medium dot which are used by the first ejecting part 23*a* and the second ejecting part 23*b* are identical to each other while driving signals used at the time of non-ejection are different from each other. In this case, the third ejection pulse 764 is removed from the second basic waveform 7*b* in FIG. 15, for example, and respective waveforms of the minute pulse 751 in FIG. 14 and the minute pulse 761 in FIG. 15 are differentiated. Also by the foregoing operations, the quality of dots of respective sizes can be improved, so that the quality of a recorded image can be improved.

In the above embodiment, regarding the basic waveforms, simplified versions have been illustratively described, and the basic waveforms may be variously modified. For example, while each of the basic waveforms 7*a* and 7*b* includes only one minute pulse as a pulse used at the time of non-ejection in the above embodiment, a plurality of minute pulses may be included. Also, a minute pulse which serves as one unit for control does not necessarily has a waveform in a shape of an upward convex, and may have a waveform in a shape of a downward convex or a shape in which an upward convex and a downward convex alternate, for example. Further alternatively, a minute pulse may have a waveform in a shape in which a plurality of upward or downward peaks are present.

A basic waveform may further include at least one minute pulse which is used in combination with an ejection pulse for ejecting a droplet. Such minute pulse may be used also at the time of non-ejection. Further, such minute pulse may be provided not only before an ejection pulse, but also after an ejection pulse, in a driving signal. By adjusting the waveform using such minute pulse as further included could make it possible to more easily determine an ejection pulse.

Moreover, in forming a medium dot with the use of the first basic waveform 7*a* illustrated in FIG. 4, the second ejection pulse 721 may be used in place of the first ejection pulse 712.

When further inclusion of a minute pulse used in combination with an ejection pulse for ejection and formation of a medium dot using the second ejection pulse 721 are taken into account, more general representation of operations performed with the use of the basic waveforms 7*a* and 7*b* in FIGS. 4, 9, 14, and 15 are as follows. In ejecting a droplet for a large dot from the first ejecting part 23*a*, a driving signal which includes the second ejection pulse 721 and the first ejection pulse 712 and does not include the third ejection pulse 722 is generated. In ejecting a droplet for a medium dot from the first ejecting part 23*a*, a driving signal which includes one of the first ejection pulse 712 and the second ejection pulse 721, and does not include either the other of the first and second ejection pulses 712 and 721 or the third ejection pulse 722 is generated. In ejecting a droplet for a small dot from the first ejecting part 23*a*, a driving signal which includes the third ejection pulse 722 and does not include either the first ejection pulse 712 or the second ejection pulse 721 is generated.

Also, in ejecting a droplet for a large dot from the second ejecting part 23*b*, a driving signal which includes the second ejection pulse 741 and the first ejection pulse 732 and does not include the third ejection pulse 742 is generated. In ejecting a droplet for a medium dot from the second ejecting part 23*b*, a driving signal which includes the third ejection pulse 742 and does not include either the first ejection pulse 732 or the second ejection pulse 741 is generated. Accordingly, high-quality four values and three values can be output in a short driving cycle.

In the meantime, while the first ejecting part 23*a* and the second ejecting part 23*b* are capable of forming dots of three different sizes, the first and second ejecting parts 23*a* and 23*b* may be so designed that they can form dots of four or more different sizes. To this end, for example, the first ejecting part 23*a* forms dots of four or more different sizes, and the second ejecting parts 23*b* forms dots of fewer sizes. Alternatively, while the first ejecting part 23*a* and the second ejecting parts 23*b* are capable of forming dots of four or more different sizes, the first ejecting part 23*a* may form dots of only three sizes and the second ejecting part 23*b* may form dots of only two sizes.

To put it generally, when m is an integer equal to or more than two, the first ejecting part 23*a* ejects ink in a first color and is capable of forming dots of m or more different sizes (in other words, the first ejecting part 23*a* is capable of outputting (m+1) values), and the second ejecting part 23*b* ejects ink in a second color different from the first color and is capable of forming dots of m or more different sizes similarly to the first ejecting part 23*a*. Then, the first ejecting part 23*a* forms dots of m different sizes, and the second ejecting part 23*b* forms dots of n different sizes (n is an integer equal to or more than one and smaller than m) included in the m different sizes (in other words, the second ejecting part 23*b* is capable of outputting (n+1) values). It is noted that the n different sizes are arbitrary sizes included in the m different sizes.

Preferably, a driving signals used for forming a dot of at least one size included in the n different sizes in the first ejecting part 23*a* and a driving signal used for forming a dot of the same ("at least one") size in the second ejecting part 23*b* are different from each other. Accordingly, it is possible to easily optimize a driving signal used for forming dots of n different sizes, so that the quality of a recorded image can be improved. More specifically, a driving signal used for ejection of a droplet from the first ejecting part 23*a* is generated by selecting a part of a plurality of waveform elements included in the first basic waveform, and a driving signal used for ejection of a droplet from the second ejecting part 23*b* is generated by selecting a part of a plurality of waveform elements included in the second basic waveform which is different from the first basic waveform.

More preferably, at least one waveform element selected from the first basic waveform in ejecting a droplet of one size included in the n different sizes has a part in common with at least one waveform element selected from the first basic waveform in ejecting a droplet of another size which is included in the n different sizes but is different from the one size, and at least one waveform element selected from the second basic waveform in ejecting a droplet of the one size has no waveform element in common with at least one waveform element selected from the second basic waveform in ejecting a droplet of another size described above.

Below, the above matters will be described with reference to FIGS. 4 and 9. The first ejection pulse 712 which is at least one waveform element selected from the first basic waveform 7*a* in ejecting a droplet for a dot of a medium size which is one of two sizes, has a part in common with the second ejection pulse 721 and the first ejection pulse 712 which are at least one waveform element selected from the first basic waveform 7*a* in ejecting a droplet for a dot of a large size which is the other of the two sizes. The first ejection pulse 712 is a common waveform element. The third ejection pulse 742 which is at least one waveform element selected from the second basic waveform 7*b* in ejecting a droplet for a dot of a medium size has no waveform element in common with the second ejection pulse 741 and the first ejection pulse 732 which are at least one waveform element selected from the second basic waveform 7*b* in ejecting a droplet for a dot of a large size.

By selecting a waveform element in the above-described manner, it is possible to more easily optimize a driving signal used for forming dots of the n different sizes with the use of the second basic waveform.

Meanwhile, the example illustrated in FIG. 13, when adapted to the above case in which the m different sizes and the n different sizes are defined, will be described as follows. For formation of each of dots of the n different sizes, a driving signal used for ejecting a droplet from the first ejecting part 23*a* is identical to a driving signal used for ejecting a droplet from the second ejecting part 23*b*, and a driving signal including a minute signal which is used when the first ejecting part 23*a* ejects no droplet is different from a driving signal including a minute signal which is used when the second ejecting part 23*b* ejects no droplet. Thus, a plurality of sizes of dots can be appropriately formed while standardizing a driving signal used for ejection of a droplet, so that the quality of a recorded image can be improved.

Of course, even in a case where a driving signal including a minute signal which is used when the first ejecting part 23*a* ejects no droplet is different from a driving signal including a minute signal which is used when the second ejecting part 23*b* ejects no droplet, a driving signal used for forming a dot of at least one size included in the n different sizes in the first ejecting part 23*a* may be different from a driving signal used for forming a dot of the same ("at least one") size in the second ejecting part 23*b*.

Further, while four values are output regarding C, M, and Y and three values are output regarding K according to the above-described preferred embodiment, a color set by three values is not limited to K. For example, if the spattering state of droplets in K color for respective sizes is better than that of droplets in any of C, M, and Y colors, four values may be output regarding K and three values may be output regarding C, M, and Y. Moreover, three values may be output regarding only one of C, M, and Y. In the inkjet printer 1, there is no need to output three values regarding any color at all times. Output of three values (formation of dots of n different sizes) may be optionally produced regarding a specific color according to an application purpose of an image while under normal conditions, four values are output (in other words, dots of m different sizes are formed) regarding all colors.

In most cases, when n is equal to or greater than two, that is, when m is equal to or greater than three and four or more values are output in any of the ejecting parts 23, formation of an appropriate dot (i.e., design of an appropriate driving signal) is likely to be not easy. Accordingly, the above-described operations for ejection are particularly suitable for a case where n is equal to or more than two. Also, in high-speed recording, it is preferable that n is equal to two and m is equal to three in order to shorten a driving cycle.

Hereinbefore, the preferred embodiment of the present invention has been described. However, the present invention is not limited to the above-described preferred embodiment, and various modifications are possible.

Either a part or a whole of the functions of the head controller 44 may be provided in the ejecting parts 23. Conversely, either a part or a whole of the functions of the driving circuits 231 may be provided outside of the ejecting parts 23.

In the inkjet printer 1, the recording paper 9 is caused to move relatively to the recording part 2 in the scanning direction by the paper feeding mechanism 3 serving as a scanning mechanism. Alternatively, a scanning mechanism which moves the recording part in the Y direction may be provided. Further alternatively, the recording paper 9 may be held by a roller and the recording paper 9 may be caused to move relatively to the recording part 2 in the scanning direction by a motor rotating the roller. As is described, a scanning mechanism for moving the recording paper 9 relatively to the recording part 2 in the scanning direction may be implemented by various structures.

The inkjet printer may be of a type which records an image on a recording paper in the form of a sheet. For example, in an inkjet printer which holds a recording paper on a stage, the length of an array of a plurality of outlets arranged in the width direction is smaller than the width of a recording area of a recording paper, and a scanning mechanism which moves the recording part relatively to the recording paper in the scanning direction and the width direction is provided. Then, the recording part moves relatively to the recording paper in the scanning direction (main scanning) while ejecting ink, to reach the edge of the recording paper, and subsequently travels a predetermined distance relatively to the recording paper in the width direction (sub-scanning). Thereafter, the recording part moves relatively to the recording paper in a direction opposite to the direction of the previous main scanning while ejecting ink. Thus, in the foregoing inkjet printer, in addition to main scanning of the recording paper in the scanning direction being made by the recording part, intermittent sub-scanning in the width direction is made every time the main scanning is finished, so that an image is recorded over the whole of the recording paper. However, from the viewpoint of increase in speed in image recording, it is preferable to adopt the foregoing method in the inkjet printer 1 of a single-pass printing type in which image recording is completed only by one-time passage of the recording paper 9 under the recording part.

In each of the ejecting parts 23, the plurality of outlets may be arranged along a horizontal line tilted in the X direction. Also, the plurality of outlets in each of the ejecting parts 23 may be in a staggered arrangement.

An object on which an image is to be record in the inkjet printer 1 may be a base material in a shape of a plate or a film formed of plastic or the like, other than the recording paper 9.

The structures described above in the preferred embodiment and the modifications can be appropriately combined unless contradiction arises.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2011-216092 filed in the Japan Patent Office on Sep. 30, 2011, the entire disclosure of which is incorporated herein by reference.

REFERENCE SIGNS LIST

1 Inkjet printer
2 Recording part
9 Recording paper
3 Paper feeding mechanism
4 Control part
7*a* First basic waveform
7*b* Second basic waveform
23*a* First ejecting part
23*b* Second ejecting part
71, 72, 73, 74 Waveform-element sequence
241 Outlet

711, 731 Minute pulse
712, 732 First ejection pulse
721, 741 Second ejection pulse
722, 742 Third ejection pulse
441 Selector
442 Input part
S11-S15 Step

The invention claimed is:

1. An inkjet printer, comprising:

a recording part for ejecting droplets of ink from an outlet toward an object, to form dots on said object;

a moving mechanism for moving said object relatively to said recording part in a moving direction; and a controller for sequentially inputting signals to said recording part, said signals being instructions for ejection of droplets, in parallel with movement of said object relative to said recording part, wherein said recording part includes: a first ejecting part which ejects ink in a first color and is capable of forming dots of m or more different sizes, m being an integer equal to or more than two; and a second ejecting part which ejects ink in a second color different from said first color, and is capable of forming dots of said m or more different sizes, said first ejecting part forms dots of said m different sizes and said second ejecting part forms dots of n different sizes included in said m different sizes, n being an integer equal to or more than one and smaller than m, a driving signal used for forming a dot of at least one size included in said n different sizes by said first ejecting part and a driving signal used for forming a dot of said at least one size by said second ejecting part are different from each other, a driving signal used for ejection of a droplet from said first ejecting part is generated by selecting a part of a plurality of waveform elements included in a first basic waveform, and a driving signal used for ejection of a droplet from said second ejecting part is generated by selecting a part of a plurality of waveform elements included in a second basic waveform different from said first basic waveform.

2. The inkjet printer according to claim 1, wherein at least one waveform element selected from said first basic waveform in ejecting a droplet of one size included in said n different sizes has a part in common with at least one waveform element selected from said first basic waveform in ejecting a droplet of another size included in said n different sizes, and at least one waveform element selected from said second basic waveform in ejecting a droplet of said one size has no waveform element in common with at least one waveform element selected from said second basic waveform in ejecting a droplet of said another size.

3. The inkjet printer according to claim 2, wherein each of said first basic waveform and said second basic waveform is two waveform-element sequences running in parallel with each other, one waveform-element sequence out of said two waveform-element sequences including a first ejection pulse and the other waveform-element sequence including a second ejection pulse and a third ejection pulse which are arranged in this order, a driving signal which includes said second ejection pulse and said first ejection pulse and does not include said third ejection pulse is generated in ejecting a droplet for a large dot from said first ejecting part, a driving signal which includes one of said first ejection pulse and said second ejection pulse and does not include either the other of said first ejection pulse and said second ejection pulse or said third ejection pulse is generated in ejecting a droplet for a medium dot from said first ejecting part, a driving signal which includes said third ejection pulse and does not include either said first ejection pulse or said second ejection pulse is generated in ejecting a droplet for a small dot from said first ejecting part, a driving signal which includes said second ejection pulse and said first ejection pulse and does not include said third ejection pulse is generated in ejecting a droplet for a large dot from said second ejecting part, and a driving signal which includes said third ejection pulse and does not include either said first ejection pulse or said second ejection pulse is generated in ejecting a droplet for a medium dot from said second ejecting part.

4. The inkjet printer according to claim 3, wherein said one waveform-element sequence in said second basic waveform further includes a minute pulse before said first ejection pulse, and a driving signal including said minute pulse and said third ejection pulse is generated in ejecting a droplet for a medium dot from said second ejecting part.

5. The inkjet printer according to claim 1, wherein n is equal to or more than two.

6. The inkjet printer according to claim 5, wherein m is three and n is two.

7. An inkjet printer, comprising:

a recording part for ejecting droplets of ink from an outlet toward an object, to form dots on said object;

a moving mechanism for moving said object relatively to said recording part in a moving direction; and a controller for sequentially inputting signals to said recording part, said signals being instructions for ejection of droplets, in parallel with movement of said object relative to said recording part, wherein said recording part includes: a first ejecting part which ejects ink in a first color and is capable of forming dots of m or more different sizes, m being an integer equal to or more than two; and a second ejecting part which ejects ink in a second color different from said first color, and is capable of forming dots of said m or more different sizes, said first ejecting part forms dots of said m different sizes and said second ejecting part forms dots of n different sizes included in said m different sizes, n being an integer equal to or more than one and smaller than m, and a driving signal including a minute pulse used at the time when said first ejecting part ejects no droplet and a driving signal including a minute pulse used at the time when said second ejecting part ejects no droplet are different from each other, a driving signal used for ejection of a droplet from said first ejecting part is generated by selecting a part of a plurality of waveform elements included in a first basic waveform, and a driving signal used for ejection of a droplet from said second ejecting part is generated by selecting a part of a plurality of waveform elements included in a second basic waveform different from said first basic waveform.

8. The inkjet printer according to claim 7, wherein driving signals respectively used in said first ejecting part and said second ejecting part in forming dots of each of said n different sizes are identical to with each other.

9. The inkjet printer according to claim 7, wherein n is equal to or more than two.

10. The inkjet printer according to claim 9, wherein m is three and n is two.

11. An image recording method adopted in an inkjet printer, said inkjet printer including a recording part which ejects droplets of ink from an outlet toward an object, to form dots on said object, said method comprising the steps of:

a) moving said object relatively to said recording part in a moving direction; and b) sequentially inputting signals which are instructions for ejection of droplets to said recording part, in parallel with movement of said object relative to said recording part, wherein said recording part includes: a first ejecting part which ejects ink in a first color and is capable of forming dots of m or more different sizes, m being an integer equal to or more than two; and a second ejecting part which ejects ink in a second color different from said first color, and is capable of forming dots of said m or more different sizes, said first ejecting part forms dots of said m different sizes and said second ejecting part forms dots of n different sizes included in said m different sizes, n being an integer equal to or more than one and smaller than m, in said step b), and a driving signal used for forming a dot of at least one size included in said n different sizes by said first ejecting part and a driving signal used for forming a dot of said at least one size by said second ejecting part are different from each other, a driving signal used for ejection of a droplet from said first ejecting part is generated by selecting a part of a plurality of waveform elements included in a first basic waveform, and a driving signal used for ejection of a droplet from said second ejecting part is generated by selecting a part of a plurality of waveform elements included in a second basic waveform different from said first basic waveform.

12. The image recording method according to claim 11, wherein at least one waveform element selected from said first basic waveform in ejecting a droplet of one size included in said n different sizes has a part in common with at least one waveform element selected from said first basic waveform in ejecting a droplet of another size included in said n different sizes, and at least one waveform element selected from said second basic waveform in ejecting a droplet of said one size has no waveform element in common with at least one waveform element selected from said second basic waveform in ejecting a droplet of said another size.

13. The image recording method according to claim 12, wherein each of said first basic waveform and said second basic waveform is two waveform-element sequences running in parallel with each other, one waveform-element sequence out of said two waveform-element sequences including a first ejection pulse and the other waveform-element sequence including a second ejection pulse and a third ejection pulse which are arranged in this order, a driving signal which includes said second ejection pulse and said first ejection pulse and does not include said third ejection pulse is generated in ejecting a droplet for a large dot from said first ejecting part, a driving signal which includes one of said first ejection pulse and said second ejection pulse and does not include either the other of said first ejection pulse and said second ejection pulse or said third ejection pulse is generated in ejecting a droplet for a medium dot from said first ejecting part, a driving signal which includes said third ejection pulse and does not include either said first ejection pulse or said second ejection pulse is generated in ejecting a droplet for a small dot from said first ejecting part, a driving signal which includes said second ejection pulse and said first ejection pulse and does not include said third ejection pulse is generated in ejecting a droplet for a large dot from said second ejecting part, and a driving signal which includes said third ejection pulse and does not include either said first ejection pulse or said second ejection pulse is generated in ejecting a droplet for a medium dot from said second ejecting part.

14. The image recording method according to claim 13, wherein said one waveform-element sequence in said second basic waveform further includes a minute pulse before said first ejection pulse, and a driving signal including said minute pulse and said third ejection pulse is generated in ejecting a droplet for a medium dot from said second ejecting part.

15. The image recording method according to claim 14, wherein n is equal to or more than two.

16. The image recording method according to claim 15, wherein m is three and n is two.

17. An image recording method adopted in an inkjet printer, said inkjet printer including a recording part which ejects droplets of ink from an outlet toward an object, to form dots on said object, said method comprising the steps of:

a) moving said object relatively to said recording part in a moving direction; and b) sequentially inputting signals which are instructions for ejection of droplets to said recording part, in parallel with movement of said object relative to said recording part, wherein said recording part includes: a first ejecting part which ejects ink in a first color and is capable of forming dots of m or more different sizes, m being an integer equal to or more than two; and a second ejecting part which ejects ink in a second color different from said first color, and is capable of forming dots of said m or more different sizes, said first ejecting part forms dots of said m different sizes and said second ejecting part forms dots of n different sizes included in said m different sizes, n being an integer equal to or more than one and smaller than m, in said step b), and a driving signal including a minute pulse used at the time when said first ejecting part ejects no droplet and a driving signal including a minute pulse used at the time when said second ejecting part ejects no droplet are different from each other, a driving signal used for ejection of a droplet from said first ejecting part is generated by selecting a part of a plurality of waveform elements included in a first basic waveform, and a driving signal used for ejection of a droplet from said second ejecting part is generated by selecting a part of a plurality of waveform elements included in a second basic waveform different from said first basic waveform.

18. The image recording method according to claim 17, wherein driving signals respectively used in said first ejecting part and said second ejecting part in forming dots of each of said n different sizes are identical to with each other.

19. The image recording method according to claim 17, wherein n is equal to or more than two.

20. The image recording method according to claim 19, wherein m is three and n is two.

* * * * *